US008147127B2

(12) United States Patent
Silva

(10) Patent No.: US 8,147,127 B2
(45) Date of Patent: Apr. 3, 2012

(54) FIXATION OF A SPIRAL SPRING IN A WATCH MOVEMENT

(75) Inventor: Sergio Silva, Geneva (CH)

(73) Assignee: Manufacture Roger Dubuis S.A., Meyrin (CH)

( * ) Notice: Subject to any disclaimer, the term of this patent is extended or adjusted under 35 U.S.C. 154(b) by 678 days.

(21) Appl. No.: 12/338,311

(22) Filed: Dec. 18, 2008

(65) Prior Publication Data

US 2010/0157743 A1 Jun. 24, 2010

(51) Int. Cl.
*G04B 1/10* (2006.01)
*G04B 17/20* (2006.01)

(52) U.S. Cl. ..... 368/144; 368/170

(58) Field of Classification Search ..... 368/140, 368/144, 170

See application file for complete search history.

(56) References Cited

U.S. PATENT DOCUMENTS

| | | | | |
|---|---|---|---|---|
| 2,842,935 | A * | 7/1958 | Bradley | 368/177 |
| 3,121,307 | A * | 2/1964 | Greiner | 368/177 |
| 3,364,673 | A * | 1/1968 | Boult | 368/177 |
| 3,673,376 | A * | 6/1972 | Kullmann | 219/121.64 |
| 3,868,490 | A * | 2/1975 | Aeschlimann et al. | 219/121.64 |
| 2010/0061192 | A1 * | 3/2010 | Hessler et al. | 368/177 |

* cited by examiner

*Primary Examiner* — Sean Kayes
(74) *Attorney, Agent, or Firm* — Westerman, Hattori, Daniels & Adrian, LLP

(57) ABSTRACT

A method is disclosed for making an isochronous balance-wheel-and-spring assembly for a horological movement in which one spring out of a series of springs is paired with a balance wheel. The spring has characteristics that vary by comparison with other springs of the series, and the spring is designed to be mounted on the staff of the balance wheel via a collet. One collet out of a set of collets of different sizes is selected on the basis of the spring's characteristics. The collets of different sizes have connection points for attachment of the spring that are located (after assembly) at different distances from the center of the balance staff, the choice of the collet of the most appropriate size facilitating the adjustment of the balance-wheel-and-spring assembly.

20 Claims, 4 Drawing Sheets

FIXATION OF A SPIRAL SPRING IN A WATCH MOVEMENT

TECHNICAL FIELD

The present invention relates to a method for fixing a spring for a mechanical balance-wheel-and-spring oscillator for a horological movement which, in particular, simplifies the necessary steps of adjustment during and after the fixing despite the presence of defects and/or variations in the spring resulting from its manufacture.

PRIOR ART

The governor of a mechanical watch is conventionally an inertial flywheel known as the balance wheel, with a spiral-wound spring known as the spring or balance spring. This balance-wheel-and-spring assembly is at the heart of the governing assembly of a mechanical horological movement. Nowadays, the balance spring used in mechanical watch movements is usually a metallic spring strip such as an Fe—Ni based alloy of rectangular section, wound up on itself into an Archimedean spiral of from 12 to 15 coils.

The inner end of the spring is conventionally fixed to the balance staff by means of a collet. Various different forms of collet are possible and it typically comprises a split cylindrical part which can be fitted with limited lubrication on the balance staff. The collet has a lateral opening or other connection point to take the inner end of the spring which is fixed to the collet by a pin or by adhesive bonding or laser welding or other means. The outer end of the spring is fastened by a stud to a bridge, known as a cock, in which the staff pivots.

The balance-wheel-and-spring assembly oscillates about its position of equilibrium (or neutral point). As the balance wheel moves away from this position, it winds the spring. This creates a return torque which, when the balance wheel is released, makes it return to its position of equilibrium. As it has acquired a certain speed, and hence kinetic energy, it overshoots its neutral point until the opposing torque of the spring stops it and sends it back in the other direction. In this way, the balance-wheel-and-spring assembly governs the oscillation period of the balance wheel.

The accuracy of a mechanical horological movement is a function of the quality of the balance-wheel-and-spring, which includes in particular its isochronism. Manufacture of the governing part is generally costly, and maintaining a constant quality is a major challenge.

In any given series of springs (produced by a given manufacturing method) and any given series of balance wheels, each spring and each balance wheel has, owing to manufacturing tolerances, various defects and, as a result, their characteristics vary to some extent. For this reason watchmakers must first put each spring together with a standard balance wheel in order to divide up the springs into a large number of categories or classes based on their respective elastic constants. In a similar way, balance wheels are also divided up into a large number of classes based on their respective inertias. Traditionally, depending on the degree of accuracy required, up to 20 classes of springs and 20 classes of balance wheels are used, and the springs from one particular class are paired with the balance wheels of a corresponding class. Clearly, the greater the number of classes of springs and balance wheels, the more difficult and laborious it becomes to pair them up and the more the proportion of unusable parts rises.

After being paired up, a meticulous and lengthy adjustment of the governing part is always necessary to ensure that the governing part is isochronous. This operation similarly requires a high level of manual intervention and many defective parts have to be thrown away.

The isochronism of a balance-wheel-and-spring assembly depends on a number of parameters of the assembly. One of these critical parameters is the attachment point of the spring, which is where the spring leaves the collet. This attachment point is determined angularly with respect to the point corresponding to the active length of the spring. Typically, this is either a point situated between the stud and the pins of an index which is used to lengthen or shorten this active length, or the point of attachment of the spring to the stud in the case of a free (that is, index-less) balance-wheel-and-spring.

Owing to its outermost and innermost attachments, the center of gravity of the spring does not remain centered on the staff of the balance wheel and the torque of the spring does not therefore remain directly proportional to its elongation. For this reason, the angle of the attachment point plays an important part in the variation of the isochronism between the different positions of the watch. See, for example, Reymondin et al., *Théorie d'horlogerie*, [Theory of Horology], Féderation des Ecoles Techniques (1998). Painstaking testing is usually required to determine the optimal position of the point of attachment of the spring to the collet, that is to say the point offering the least variation of isochronism. As indicated in the text cited above, Caspari's rule suggests that the point of attachment to the collet is 90° or 270° away from the outermost point of attachment to achieve isochronism of the oscillations.

During and after the fixing of the spring to the collet, it is then very important to maintain this angle of the point of attachment. At the same time, to maintain isochronism, it is also important for the fixing of the spring to the collet to be stress-free and in particular for 1) the distance between the point of origin of the spring and the balance staff to be as small as possible and 2) the spring to leave the collet tangentially to this point of origin.

However, in reality, as already indicated, each spring has defects of manufacture, and even when one class of springs is paired with one class of balance wheels, it is still difficult to satisfy each of the above requirements for all springs of a given class. As a result, a large proportion of springs in a given series are still unusable.

It would therefore be an advantage, during and after fixing a series of springs into multiple balance-wheel-and-spring assemblies, to reduce the proportion of defective and/or unusable springs and the amount of time and effort required to produce a sufficiently isochronous balance-wheel-and-spring assembly. In particular it would also be advantage if the number of classes of springs necessary for pairing up with balance wheels could be reduced.

SUMMARY OF THE INVENTION

The present invention provides a method for fixing a spring into a balance-wheel-and-spring assembly whereby the limitations of the prior art are overcome, among other things by increasing the proportion of springs that can be used, thereby partly offsetting manufacturing defects, and by simplifying to some extent the adjustment steps necessary during and after fixings.

It is another object of the invention to provide a method for making an isochronous balance-wheel-and-spring assembly in which one spring out of a series of springs is paired with a balance wheel. The spring has characteristics that vary by comparison with other springs of the series, and the spring is designed to be mounted on the staff of the balance wheel via a collet. One collet is selected from a set of collets of different sizes on the basis of the spring's characteristics. The collets of different sizes have connection points for attachment of the spring that are located (after assembly) at different distances from the center of the staff of the balance wheel, and the choice of the collet of the most appropriate size facilitates the adjustment of the balance-wheel-and-spring assembly.

In particular, the choice of the collet of the most appropriate size avoids stress on the inner end of the spring. This safeguards the angle of the point of attachment of this spring to the collet and, at the same time, ensures that the origin of the spring does not move away from the center of the balance staff, and also ensures that the spring leaves the collet tangentially.

The spring and the balance wheel are preferably divided up into classes before being paired, but the number of classes of springs is less than or equal to five, while maintaining an accuracy of +/−100 seconds/day or less for the balance-wheel-and-spring assembly which is produced.

In one embodiment, the collet is selected at least partly on the basis of the position and curvature of the innermost coil of the spring.

The set of collets preferably comprises collets of at least three different sizes, in which case the size gradation between the different collets may be uniform.

The present invention also provides a set of collets of this kind.

BRIEF DESCRIPTION OF THE FIGURES

Examples of embodiments of the invention are indicated in the description illustrated by the accompanying figures, in which.

EXAMPLE OF AN EMBODIMENT OF THE INVENTION

Figure 1:
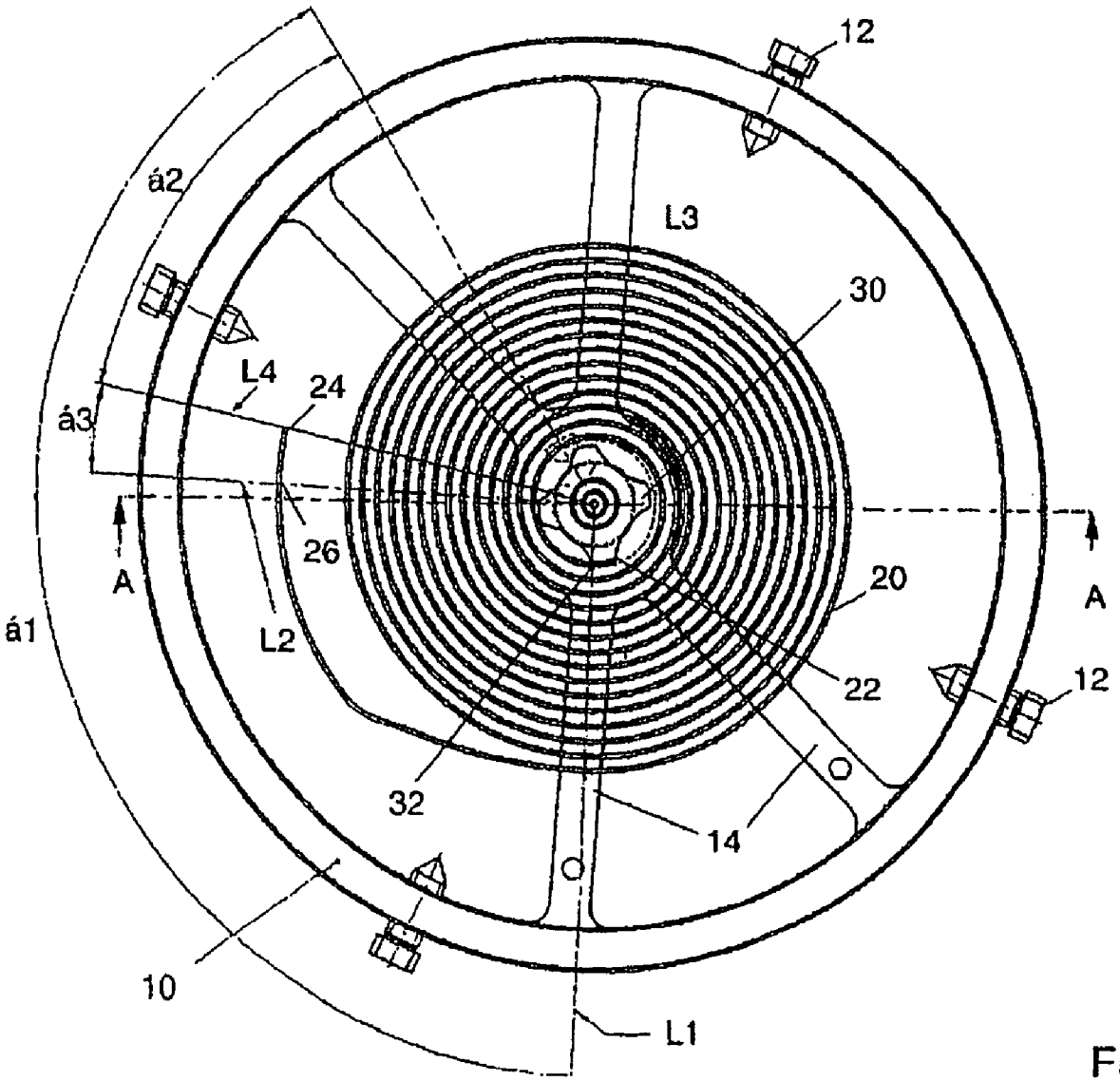
FIG. 1 is a plan view of a conventional balance-wheel-and-spring assembly.
Figure 2:
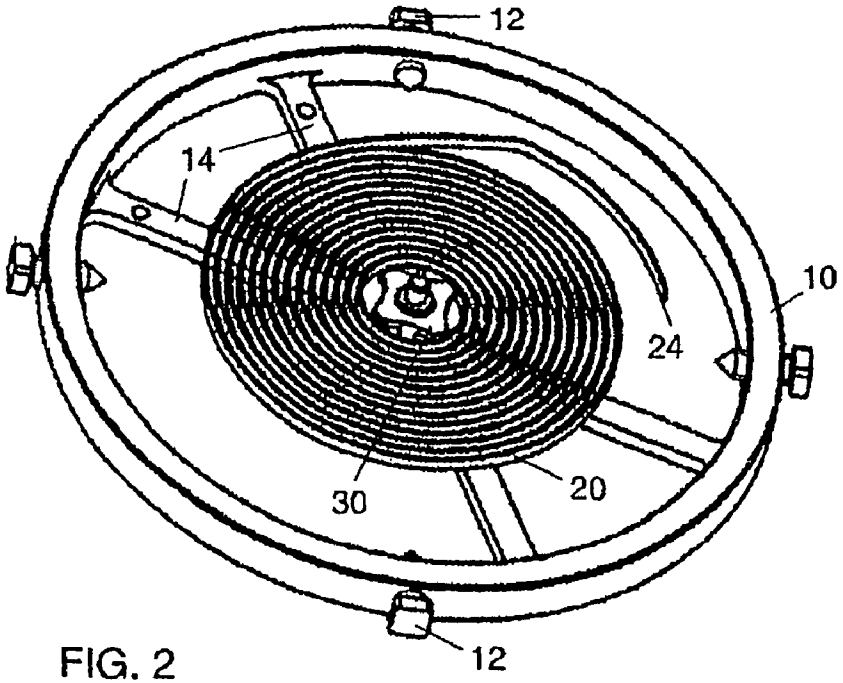
FIG. 2 shows the balance-wheel-and-spring assembly in a perspective view.
Figure 3:
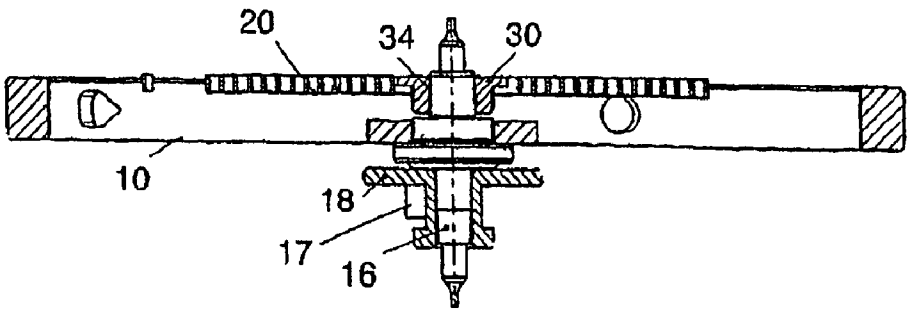
FIG. 3 shows the balance-wheel-and-spring assembly in a transverse section taken on the line marked A-A in FIG. 1.

A conventional balance-wheel-and-spring assembly is shown in FIGS. 1-3. It comprises a balance wheel 10 which in this example has a number of adjustment screws 12 and arms 14. The position, number and even the presence of the screws 12 may vary depending on the type of balance wheel. A roller 18 (in this case a double roller) is mounted on the balance staff 16 and carries a pin 17 which receives the impulses from an escapement anchor (not shown). The spring 20 has an innermost coil which ends in an inner end 22, and an outermost coil which ends in an outer end 24. As explained below, the spring 20 is mounted on the staff 16 via a collet 30. Specifically, the spring is fixed towards its inner end 22 to a connection point 32 on the collet. At a point 26 towards its outer end 24, the spring is fixed to the bridge of the balance wheel (not shown) by a stud (also not shown).

In general terms, the balance wheel 10 and the spring 20 can each be made from a variety of materials and by a variety of methods, but this does not affect the method of the present invention.

The collet 30 may take a great variety of forms. It must of course have an internal structure allowing it to be mounted on the balance staff 16 and, for this purpose, the collet 30 comprises a cylindrical inner hole 34. The collet must also help to keep the center of gravity of the balance-wheel-and-spring assembly on the center of the balance staff. In general terms the collet must also be small in order to have only a small influence on the moment of inertia of the balance-wheel-and-spring assembly. The shape of the collet 30 illustrated in FIGS. 1-3 is therefore purely an example. The collet may be made of steel or any other appropriate material, and once again this does not affect the method of the present invention.

As explained above, after the spring 20 has been paired with the balance wheel 10, a meticulous adjustment of the assembly is necessary to make it sufficiently isochronous. During this adjustment several parameters have to be adjusted. A detailed discussion of this adjustment and all the parameters in question is beyond the scope of the present description, but FIG. 1 shows a number of these parameters, including in particular the attachment point of the spring.

In particular, FIG. 1 shows a line L1 showing the angular position of the point of attachment of the spring to the collet 30, a line L2 showing the angular position of the point of attachment of the spring to the stud, a line L3 showing the angular position of the impulse pin 17, and a line L4 showing the angular position of the outer end of the spring. Each line L1-L4 is a straight line beginning at the center of the balance staff 16 and passing through the corresponding point of the assembly.

Lines L1-L4 define three angles in particular: angle a1 between the point of attachment to the collet 30 and the impulse pin 17; angle a2 between the impulse pin 17 and the outer end of the spring 24; and angle a3 between the point 26 of attachment of the spring to the stud and the outer end of the spring 24. In an embodiment offered as an example, after the balance-wheel-and-spring assembly has been adjusted the above angles should have the following values:

a1=147.2°
a2=47.2°
a3=10°

It will be seen that the angle between the line L1 of the point of attachment to the collet and the line L2 of the point of attachment to the stud is 90° in this example.

During and after the fixing of the spring to the collet when the collet is mounted on the balance staff 16, these angles must be maintained, with particular care being taken to ensure that the angle of the point of attachment to the collect is not modified. As pointed out earlier, it is also important that the point of origin of the spring remains on or close to the center of the staff 16. The spring must also leave the collet tangentially to this point of origin.

To increase the probability that each of these requirements can be met with a given balance-wheel-and-spring pair and so facilitate this job of adjustment, the present invention provides for the selection, from a set of collets of different sizes, of one collet of the most appropriate size for the specific characteristics of the spring in question.

Figure 4:
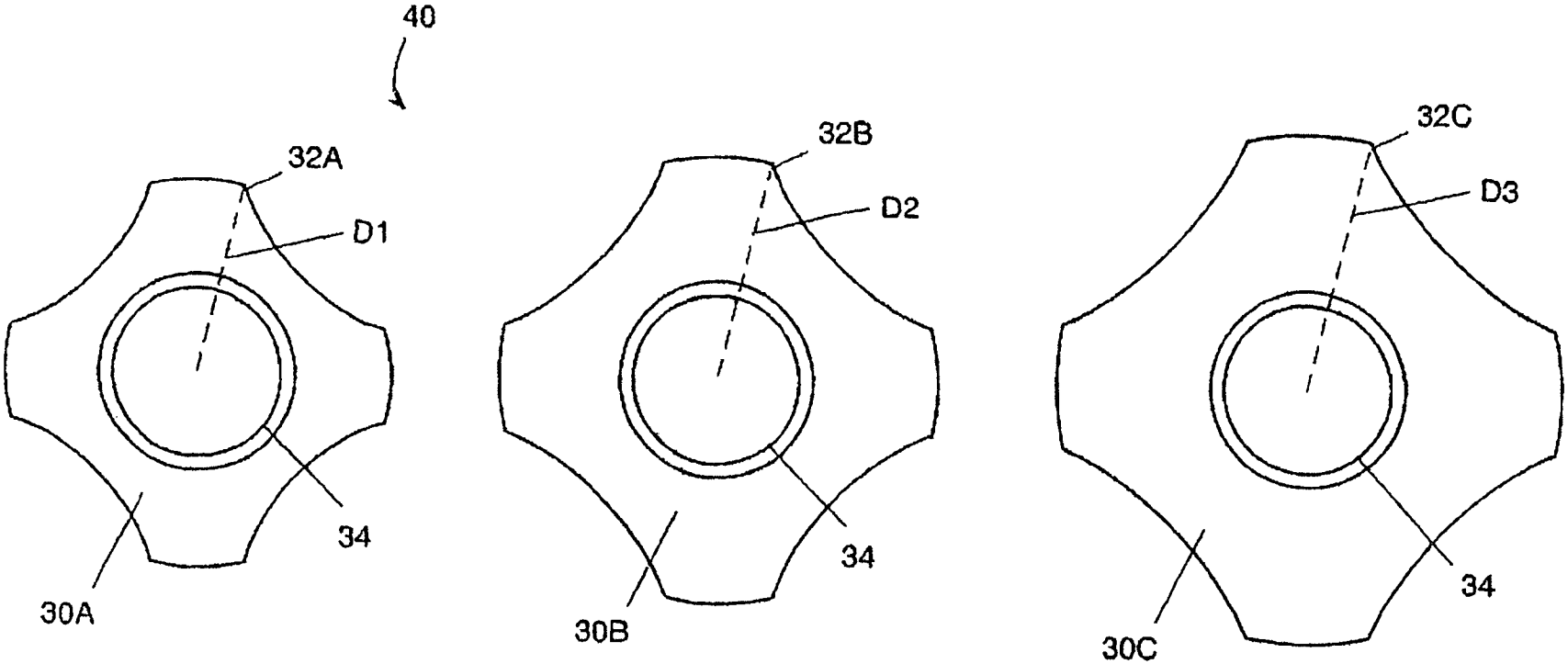
FIG. 4 shows a series of collets of different sizes in accordance with one embodiment of the invention.

The set of collets must comprises collets of at least two different sizes. To take an example, a set 40 of three collets 30A, 30B, 30C of different sizes is shown in FIG. 4. Each collet 30A, 30B, 30C has a connection point 32A, 32B, 32C, respectively located at a distance D1, D2, D3, respectively, from the center of the balance staff. In the case of cylindrical collets the distances D1, D2, D3 correspond essentially to the radius of the collet, but, as has already been explained, collets of other shapes are also possible. Of course, all the collets 30A, 30B, 30C are designed to be mounted on effectively identical balance staffs, and for this reason may all have, for example, a cylindrical internal hole 34 of the same diameter.

According to the invention, each of the distances D1, D2, D3 of the collets in the set 40 is different from the corresponding distances of all the other collets in the set. In the set 40, collet 30A has a shorter distance D1 than distances D2 and D3 of collets 30B and 30C, collet 30C has a greater distance D3 than distances D1 and D2 of collets 30A and 30B, and collet 30B has a distance D2 in between distances D1 and D3 of collets 30A and 30C.

In one embodiment of the invention, the gradation of sizes between the different collets is uniform such that D3−D2=D2−D1. In an embodiment in which balance wheels having diameters of between 7 and 12 mm are used, the set of collets comprises four different sizes having connection points 32 located at 0.225 mm, 0.25 mm, 0.275 mm, and 0.30 mm, respectively, from the center of the balance staff (corresponding to diameters of 0.45 mm, 0.50 mm, 0.55 mm, and 0.60 mm in the case of cylindrical collets).

Figure 5:
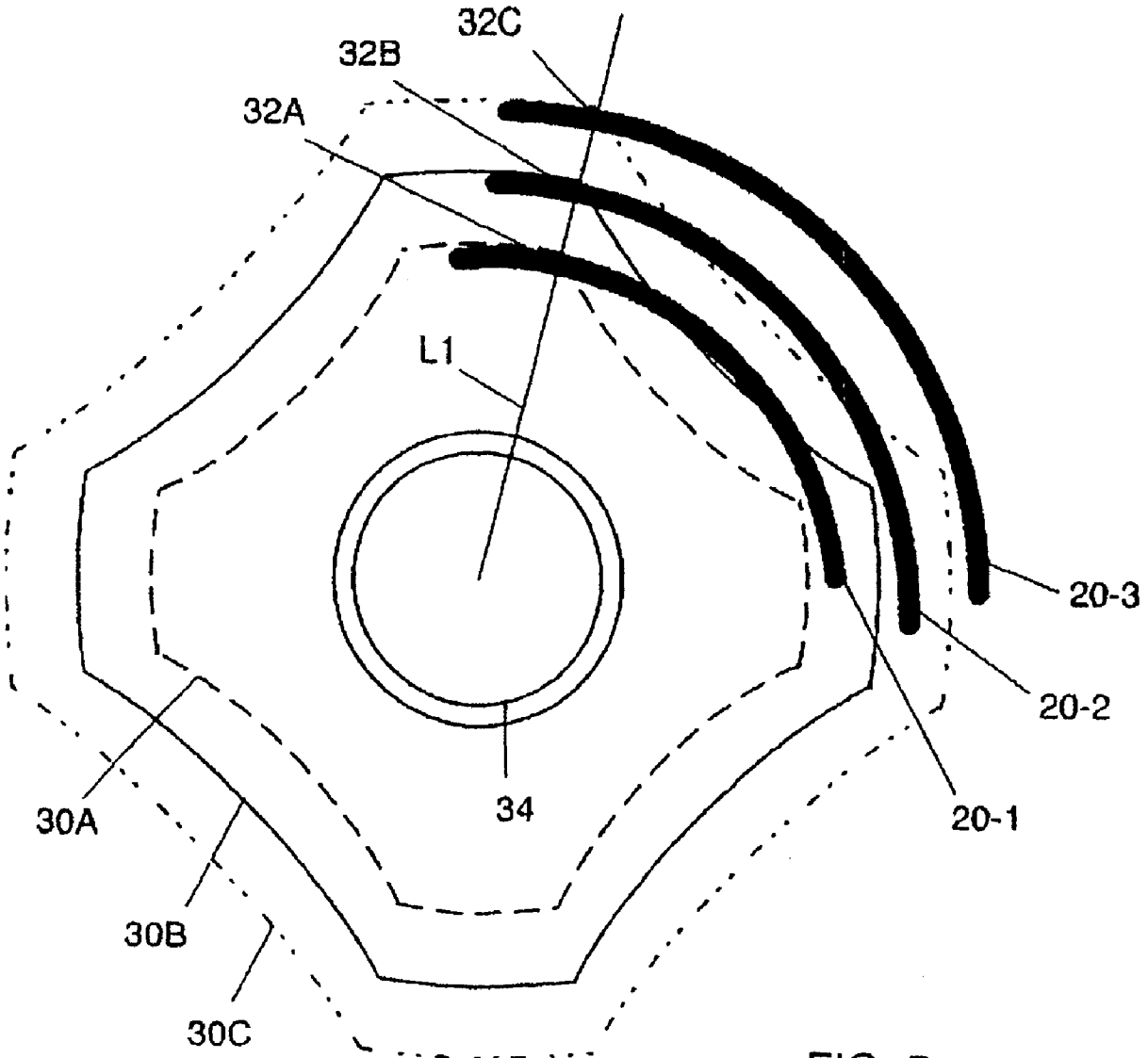
FIG. 5 shows how different springs can be fixed via a collet of the most appropriate size in this embodiment of the invention while maintaining the angle of their point of attachment.

FIG. 5 illustrates how the selection of a collet with the most appropriate size for a given spring facilitates the fitting of the spring in such a way as to best ensure that the origin of the spring stays close to the center of the staff 16 and that the spring leaves the collet tangentially without affecting, in particular, the angle of the point of attachment of the spring. As illustrated, in light of the presence of defects and/or variations in the manufacture of a series of springs, the position and curvature of the innermost coil of three different springs 20-1, 20-2, 20-3 in particular may vary. In accordance with the invention the effect of such variations is minimized by selecting a connection point 32A, 32B or 32C that is the most appropriate for the attachment of that particular spring. Specifically, selecting this connection point 32A, 32B, 32C to be the most appropriate for the spring in question ensures that there is no stress on the inner end 22 of the spring. In other words, it is no longer necessary to force this inner end 22 to adopt a position much further from or much closer to the balance staff compared with its rest (that is, unstressed) position.

Referring to FIG. 5, it will be seen that spring 20-1 is the most appropriate choice for fixing collet 30A, spring 20-2 the most appropriate choice for fixing collet 30B, and spring 20-3 the most appropriate choice for fixing collet 30C. At the same time, the angle of the line of the point of attachment of the spring to the collet L1 is not affected by this choice of collet and it is therefore easier to keep the necessary values for the angles a1 to a3 to adjust the balance-wheel-and-spring assembly. It should be pointed out that in FIGS. 4 and 5 the differences between the sizes of the collets and between the shapes of the springs are exaggerated for ease of understanding.

If, for example, spring 20-3 had to be fixed via collet 30B, its inner end would have to be stressed by forcing it radially by a significant amount towards the balance staff. It would then be very difficult to maintain the angle of the point of attachment of this spring to the collet, and, at the same time, prevent the origin of the spring moving away from the center of the balance staff and ensure that the spring 20-3 leaves the collet 30B as tangentially as it does with collet 30C. A more difficult, more costly adjustment would therefore be required for spring 20-3 with collet 30B and, even after such efforts, spring 20-3 could still be unusable.

When using the method of making the balance-wheel-and-spring assembly and the corresponding set of collets according to the invention, the proportion of springs in a given series that cannot be used is significantly reduced. The time and effort required to adjust the balance-wheel-and-spring assembly to make it sufficiently isochronous is also less. Moreover, the number of classes of springs required for pairing up with balance wheels can also be reduced because the pairing of a spring and a balance wheel becomes less critical than in the prior art. In one embodiment in particular, the present invention allows the springs to be divided up into five classes while maintaining an accuracy of between +/−70 seconds/day and +/−110 seconds/day in the case of the balance-wheel-and-spring assemblies that are produced.

It goes without saying that the present invention is not limited to the embodiment described above, and that various modifications and simple variants can be conceived by those skilled in the art without departing from the scope of the present invention. For example, the collets in the series may differ in shape from the collets shown in the figures, and may have slots or other features. Furthermore, different collets in the same set may be of different shapes if desired—the important point is that the set comprises different sizes of collet.

REFERENCE NUMBERS EMPLOYED IN THE FIGURES

10 Balance wheel
12 Adjustment screw
14 Balance wheel arm
16 Balance staff
17 Impulse pin
18 Double roller
20 Balance spring
22 Inner end of spring
24 Outer end of spring
26 Point of attachment of spring to stud
30 Collet
32 Connection point of collet
34 Cylindrical hole of collet
L1 Line of point of attachment to collet
L2 Line of point of attachment to stud
L3 Escapement line
L4 Line of outer end of spring
a1 Angle between the line of the point of attachment to the collet and the escapement line
a2 Angle between the escapement line and the line of the outer end of the spring
a3 Angle between the line of the point of attachment to the stud and the line of the outer end of the spring
30A Collet of a first size in a set of collets
30B Collet of a second size in the set of collets
30C Collet of a third size in the set of collets
32A Connection point of collet 30A
32B Connection point of collet 30B
33C Connection point of collet 30C
40 Set of collets of different sizes

The invention claimed is:

1. A method for making a balance-wheel-and-spring assembly for a horological movement, in which:

one spring (10) out of a series of springs is paired with a balance wheel (20), the spring (10) having characteristics that vary by comparison with other springs of the series, and the spring (10) being designed to be mounted on the staff (16) of the balance wheel (10) via a collet (30); and one collet is selected from a set (40) of collets of different sizes (30A, 30B, 30C) based on the spring's characteristics, collets of different sizes having connection points (32A, 32B, 32C) for attachment of the spring (20) that are located at different distances from the center of the staff (16) of the balance wheel (10) after assembly, the choice of the collet of the most appropriate size facilitating the adjustment of the balance-wheel-and-spring assembly.

2. The method as claimed in claim 1, in which the spring (20) and the balance wheel (10) are divided up into classes before being paired.

3. The method as claimed in claim 2, in which the number of classes of springs is less than or equal to five, while maintaining an accuracy of +/−100 seconds/day or less for the balance-wheel-and-spring assembly.

4. The method as claimed in claim 3, in which the collet is selected at least partly on the basis of the position and curvature of the innermost coil of the spring (20).

5. The method as claimed in claim 4, in which the set (40) of collets comprises collets of at least three different sizes.

6. The method as claimed in claim 3, in which the set (40) of collets comprises collets of at least three different sizes.

7. The method as claimed in claim 6, in which the size gradation between the different collets is uniform.

8. The method as claimed in claim 7, in which the set (40) comprises collets of four different sizes having connection points (32) located variously at 0.225 mm, 0.25 mm, 0.275 mm, and 0.30 mm from the center of the balance staff after assembly.

9. The method as claimed in claim 2, in which the collet is selected at least partly on the basis of the position and curvature of the innermost coil of the spring (20).

10. The method as claimed in claim 9, in which the set (40) of collets comprises collets of at least three different sizes.

11. The method as claimed in claim 2, in which the set (40) of collets comprises collets of at least three different sizes.

12. The method as claimed in claim 11, in which the size gradation between the different collets is uniform.

13. The method as claimed in claim 12, in which the set (40) comprises collets of four different sizes having connection points (32) located variously at 0.225 mm, 0.25 mm, 0.275 mm, and 0.30 mm from the center of the balance staff after assembly.

14. The method as claimed in claim 1, in which the collet is selected at least partly on the basis of the position and curvature of the innermost coil of the spring (20).

15. The method as claimed in claim 14, in which the set (40) of collets comprises collets of at least three different sizes.

16. The method as claimed in claim 15, in which the size gradation between the different collets is uniform.

17. The method as claimed in claim 16, in which the set (40) comprises collets of four different sizes having connection points (32) located variously at 0.225 mm, 0.25 mm, 0.275 mm, and 0.30 mm from the center of the balance staff after assembly.

18. The method as claimed in claim 1, in which the set (40) of collets comprises collets of at least three different sizes.

19. The method as claimed in claim 18, in which the size gradation between the different collets is uniform.

20. The method as claimed in claim 19, in which the set (40) comprises collets of four different sizes having connection points (32) located variously at 0.225 mm, 0.25 mm, 0.275 mm, and 0.30 mm from the center of the balance staff after assembly.

* * * * *